US010774495B2

(12) United States Patent
Oliver et al.

(10) Patent No.: US 10,774,495 B2
(45) Date of Patent: Sep. 15, 2020

(54) STABILIZER ANCHOR ASSEMBLY FOR MANUFACTURED BUILDING

(71) Applicant: Oliver Technologies, Inc., Hohenwald, TN (US)

(72) Inventors: Scott Oliver, Linden, TN (US); John A Oliver, Linden, TN (US); Daniel Oliver, Linden, TN (US)

( * ) Notice: Subject to any disclaimer, the term of this patent is extended or adjusted under 35 U.S.C. 154(b) by 0 days.

(21) Appl. No.: 16/215,220

(22) Filed: Dec. 10, 2018

(65) Prior Publication Data

US 2019/0186097 A1 Jun. 20, 2019

Related U.S. Application Data

(63) Continuation of application No. 15/180,054, filed on Jun. 12, 2016, now abandoned.

(60) Provisional application No. 62/175,116, filed on Jun. 12, 2015.

(51) Int. Cl.

| | |
|---|---|
| ***E02D 5/80*** | (2006.01) |
| ***E02D 27/50*** | (2006.01) |
| ***E02D 27/48*** | (2006.01) |
| *E04H 12/22* | (2006.01) |

(52) U.S. Cl.

CPC ..... *E02D 5/801* (2013.01); *E02D 27/48* (2013.01); *E02D 27/50* (2013.01); *E04H 12/2223* (2013.01)

(58) Field of Classification Search

CPC ..... E02D 5/801; E02D 27/50; E02D 27/48; E02D 27/01; E02D 27/02; E02D 27/34; E04H 12/2223; Y10S 52/11; E04B 1/34352; E04B 1/34347; E04B 1/34336

See application file for complete search history.

(56) References Cited

U.S. PATENT DOCUMENTS

| | | | |
|---|---|---|---|
| 4,756,128 | A | 7/1988 | Danieli |
| 4,863,137 | A | 9/1989 | Cockman |
| 4,923,165 | A | 5/1990 | Cockman |
| 5,697,191 | A | 12/1997 | MacKarvich |
| 6,230,448 | B1 | 5/2001 | Oliver et al. |
| 6,243,998 | B1 | 6/2001 | MacKarvich |
| 6,256,940 | B1 | 7/2001 | MacKarvich |
| 6,272,798 | B1 | 8/2001 | Cockman |
| 6,298,611 | B1 | 10/2001 | Oliver et al. |
| 6,418,685 | B1 | 7/2002 | Oliver et al. |
| 6,474,028 | B2 | 11/2002 | Cusimano et al. |
| 6,634,150 | B1 | 10/2003 | Oliver et al. |
| 6,928,793 | B2 | 8/2005 | Oliver |
| 7,140,157 | B2 | 11/2006 | Oliver et al. |
| 7,526,899 | B1 | 5/2009 | Oliver et al. |
| 8,833,020 | B2 | 9/2014 | Oliver et al. |
| 8,844,209 | B1 | 9/2014 | Oliver et al. |

(Continued)

*Primary Examiner* — Jessie T Fonseca

(74) *Attorney, Agent, or Firm* — Baker Donelson; Carl M. Davis, II

(57) ABSTRACT

A stabilizer anchor securing a manufactured building to the ground while resisting movement from forces against the building, having an elongated rod with a helical flight at a first end and a connector at an opposing end, which rod slidingly receives a plate for movement relative to the rod during installation. A stabilizer member connects between a connector of the rod and an I-beam of the manufactured building for communicating forces on the building to the ground. A method of securing a manufacturing building to the ground while resisting movement in response to forces against the building is disclosed.

52 Claims, 7 Drawing Sheets

(56) References Cited

U.S. PATENT DOCUMENTS

| | | | |
|---|---|---|---|
| 8,919,060 | B1 | 12/2014 | Oliver |
| 9,206,580 | B2 | 12/2015 | Oliver et al. |
| 9,970,175 | B2 | 5/2018 | Oliver et al. |
| 2002/0088186 | A1 | 7/2002 | Cusimano |
| 2002/0088187 | A1 | 7/2002 | Howard et al. |
| 2003/0213197 | A1 | 11/2003 | Oliver et al. |
| 2005/0011149 | A1 | 1/2005 | Mard |
| 2005/0188627 | A1 | 9/2005 | Alberts |
| 2009/0038240 | A1 | 2/2009 | Leonard |
| 2011/0036025 | A1 | 2/2011 | Boulay |
| 2011/0041437 | A1 | 2/2011 | Moreno et al. |
| 2012/0011781 | A1 | 1/2012 | Moreno et al. |

STABILIZER ANCHOR ASSEMBLY FOR MANUFACTURED BUILDING

The present application is a continuation of co-pending application Ser. No. 15/180,054 filed Jun. 12, 2016, with benefit of U.S. provisional patent application Ser. No. 62/175,116, filed Jun. 12, 2015.

TECHNICAL FIELD

The present invention relates to anchors for securing a manufactured building to the ground while resisting movement from forces directed against the building. More particularly, the present invention relates to stabilizer anchors for manufactured buildings, which being engaged to the ground and the building, provide resistance in tension and compression for securing the manufactured building from movement in response to forces directed against the building.

BACKGROUND

Typical manufactured buildings use a pair of spaced-apart longitudinal support beams, often steel I-beams, to underlie the frame of the building. Foundation piers positioned on the ground extend into bearing contact with the support beams to support the building above the ground for ventilation and crawl space under the building. Additionally, anchor assemblies use a strap that connects to the building and to anchors that engage the ground with helix members or helical flights that pull the anchor into the soil during installational rotation. The foundation piers and the anchor assemblies secure the manufactured building to the ground and resist movement of the building caused by loading forces such as from earthquakes and from high winds directed against the building.

Conventional anchor assemblies use an auger-type anchor having helical flights that embed the anchor in the ground lateral to one side of the support beam and a strap member that connects between a head or connector of the anchor and the support beam of the manufactured building. The helical flight provides auger characteristics for pulling the anchor into the soil. The helical fight attaches to an end portion of an elongated shaft of the anchor. The anchor is rotated as an auger to drive the anchor into the ground by action of the helical flight. U.S. Pat. No. 6,418,685 discloses a tension anchor system having a strap and connector assembly. U.S. Pat. No. 6,505,447 discloses a foundation pier system with an elongated brace between a ground pan and the I-beam of the building. The foundation piers and a plurality of spaced-apart anchor assemblies, the number and spacing of which is dependent on soil and wind conditions, hold the manufactured building in engagement to the ground and provide resistance to movement caused by loading forces, typically wind but may be earthquakes as well, directed on the building.

While conventional anchors provide ground connections and movement resistance for manufactured building, there is a need for ground anchors to have tension and compression resistance to loading on manufactured buildings while reducing installation time and labor as well as costs. It is to such that the present invention is directed.

BRIEF SUMMARY OF THE INVENTION

The present invention meets the need in the art for an improved stabilizer anchor that provides tension and compression resistance for securing a manufactured building to the ground. More particularly, the stabilizer anchor assembly secures the manufactured building to the ground while providing resistance to movement thereof in response to forces directed against the manufactured building, with an anchor having an elongated rod with a helical flight at a first end and a threaded connector at an opposing second end that receives a first nut and a stabilizer assembly having a plate and a seating member that slidingly receives the rod for movement of the stabilizer assembly relative to the rod during installation of the anchor vertically below an elongate longitudinal I-beam on which a manufactured building is supported, the plate for engaging the ground after installation. The stabilizer assembly comprises a cylindrical cap having a base and a perimeter wall extending in a first direction therefrom defining the plate, the base defining a central opening for the seating member through which the rod extends and an annular knuckle projecting from an upper surface of the base to define a ridge, the ridge bearing against the first nut whereby the cap may be angled relative to the anchor in substantially conformity with a slope of the ground surface thereat. A stabilizer member for connecting at a first end to the connector of the anchor and at a second end to the longitudinal I-beam thereby disposing the stabilizer member substantially parallel to a longitudinal axis of the I-beam, whereby forces on the manufactured building communicate therefrom through the stabilizer member to the ground through the anchor. The plate, being moved relative to the rod during installation in the ground, resists movement of the manufactured building in response to forces against the manufactured building.

In another aspect, the present invention provides a method for securing a manufactured building to the ground with a stabilizer anchor assembly that provides resistance to movement thereof in response to forces directed against the manufactured building, comprising the steps of:

(a) slidingly extending a rod of an anchor through a seating member of a stabilizer assembly, the anchor having a helical flight at a first end for engaging a portion of ground below a longitudinal I-beam on which a manufactured building is supported and an opposing second end having a connector, said stabilizer assembly comprising a cap having a base and a perimeter wall extending in a first direction therefrom defining the plate for engaging the ground, the base defining a central opening for the seating member through which the rod extends and an annular knuckle projecting from an upper surface of the base;

(b) driving the anchor and the stabilizer assembly into the ground, the stabilizer assembly moving relative to the rod during installation of the anchor and the plate engaging the ground after installation with the cap angled relative to the anchor in substantial conformity with a slope of the ground by pivoting the cap on a ridge of the annular knuckle; and (c) connecting a first end of a stabilizer member to the connector of the anchor and connecting a second end of the stabilizer member to the longitudinal I-beam, thereby disposing the stabilizer member substantially parallel to a longitudinal axis of the I-beam, whereby forces on the manufactured building communicate therefrom through the stabilizer member to the ground through the anchor, whereby the plate, being moves relative to the rod during installation in the ground, resists movement of the manufactured building in response to forces against the manufactured building.

In another aspect, the present invention provides a stabilizer anchor assembly for securing a manufactured building to the ground while providing resistance to movement thereof in response to forces directed against the manufactured building, comprising an anchor having an elongated rod with a helical flight at a first end and a connector at an opposing second end and a stabilizer assembly having a plate and a seating member that slidingly receives the rod for movement of the stabilizer assembly relative to the rod during installation of the anchor relative to an elongate longitudinal I-beam on which a manufactured building is supported, with the plate for engaging the ground after installation. The stabilizer assembly comprising a cylindrical cap having a base and a perimeter wall extending in a first direction therefrom defining the plate, the base defining a central opening for the seating member through which the rod extends, the cap defines a radial slot in the cap extending from the central opening to an edge for receiving the rod. A stabilizer member for connecting at a first end to the connector of the anchor and at a second end to the longitudinal I-beam, whereby forces on the manufactured building communicate therefrom through the stabilizer member to the ground through the anchor. The plate, being moved relative to the rod during installation in the ground, resists movement of the manufactured building in response to forces against the manufactured building.

In yet another aspect, the present invention provides a stabilizer anchor assembly for securing a manufactured building to the ground while providing resistance to movement thereof in response to forces directed against the manufactured building, comprising an anchor having an elongated rod with a helical flight at a first end and a connector at an opposing second end and a stabilizer assembly having a plate and a seating member that slidingly receives the rod for movement of the stabilizer assembly relative to the rod during installation of the anchor relative to an elongate longitudinal I-beam on which a manufactured building is supported, the plate for engaging the ground after installation. A first stabilizer member for connecting at a first end to the connector of the anchor and at a second end to the longitudinal I-beam and a second stabilizer member for connecting at a first end to the connector of the anchor and at a second end to the longitudinal I-beam, the second stabilizer member transverse to a longitudinal axis of the I-beam determined in a horizontal plane relative to the I-beam. The plate, being moved relative to the rod during installation in the ground, resists movement of the manufactured building in response to forces against the manufactured building communicated through the first and second stabilizer members.

In yet another aspect, the present invention provides a method for securing a manufactured building to the ground with a stabilizer anchor assembly that provides resistance to movement thereof in response to forces directed against the manufactured building, comprising the steps of:

(a) slidingly extending a rod of an anchor through a seating member of a stabilizer assembly, the anchor having a helical flight at a first end for engaging a portion of ground below a longitudinal I-beam on which a manufactured building is supported and an opposing second end having a threaded portion that receives a first nut thereon; and (b) driving the anchor and the stabilizer assembly into the ground, the stabilizer assembly moving relative to the rod during installation of the anchor and the plate engaging the ground after installation;

(c) connecting a first end of a tubular stabilizer member to the connector of the anchor, the first end flattened and defining opposing openings therein for passing the rod therethrough and a second nut threaded thereon to secure the first end to the anchor; and (d) connecting a second end of the stabilizer member to the longitudinal I-beam, whereby forces on the manufactured building communicate therefrom through the stabilizer member to the ground through the anchor, whereby the plate, being moves relative to the rod during installation in the ground, resists movement of the manufactured building in response to forces against the manufactured building.

In yet another aspect, the present invention provides a method for securing a manufactured building to the ground with a stabilizer anchor assembly that provides resistance to movement thereof in response to forces directed against the manufactured building, comprising the steps of:

(a) slidingly extending a rod of an anchor through a seating member attached to a plate of a stabilizer assembly, the anchor having a helical flight at a first end for engaging a portion of ground below a longitudinal I-beam on which a manufactured building is supported and an opposing second end having a connector; and (b) driving the anchor and the stabilizer assembly into the ground, the stabilizer assembly moving relative to the rod during installation of the anchor and the plate engaging the ground after installation;

(c) connecting a first end of a stabilizer member to the connector of the anchor and connecting a second end of the stabilizer member to the longitudinal I-beam;

(d) connecting a first end of a second stabilizer member to the connector of the anchor and connecting a second end of the second stabilizer member to the longitudinal I-beam, the second stabilizer member disposed transverse to a longitudinal axis of the I-beam as determined in a horizontal plane relative to the I-beam, whereby the plate, being moved relative to the rod during installation in the ground, resists movement of the manufactured building in response to forces against the manufactured building communicated therefrom through the stabilizer members to the ground through the anchor.

Objects, features and advantages of the present invention will become apparent upon a reading of the following detailed description in conjunction with the drawings and the appended claims.

DETAILED DESCRIPTION

Figure 1:
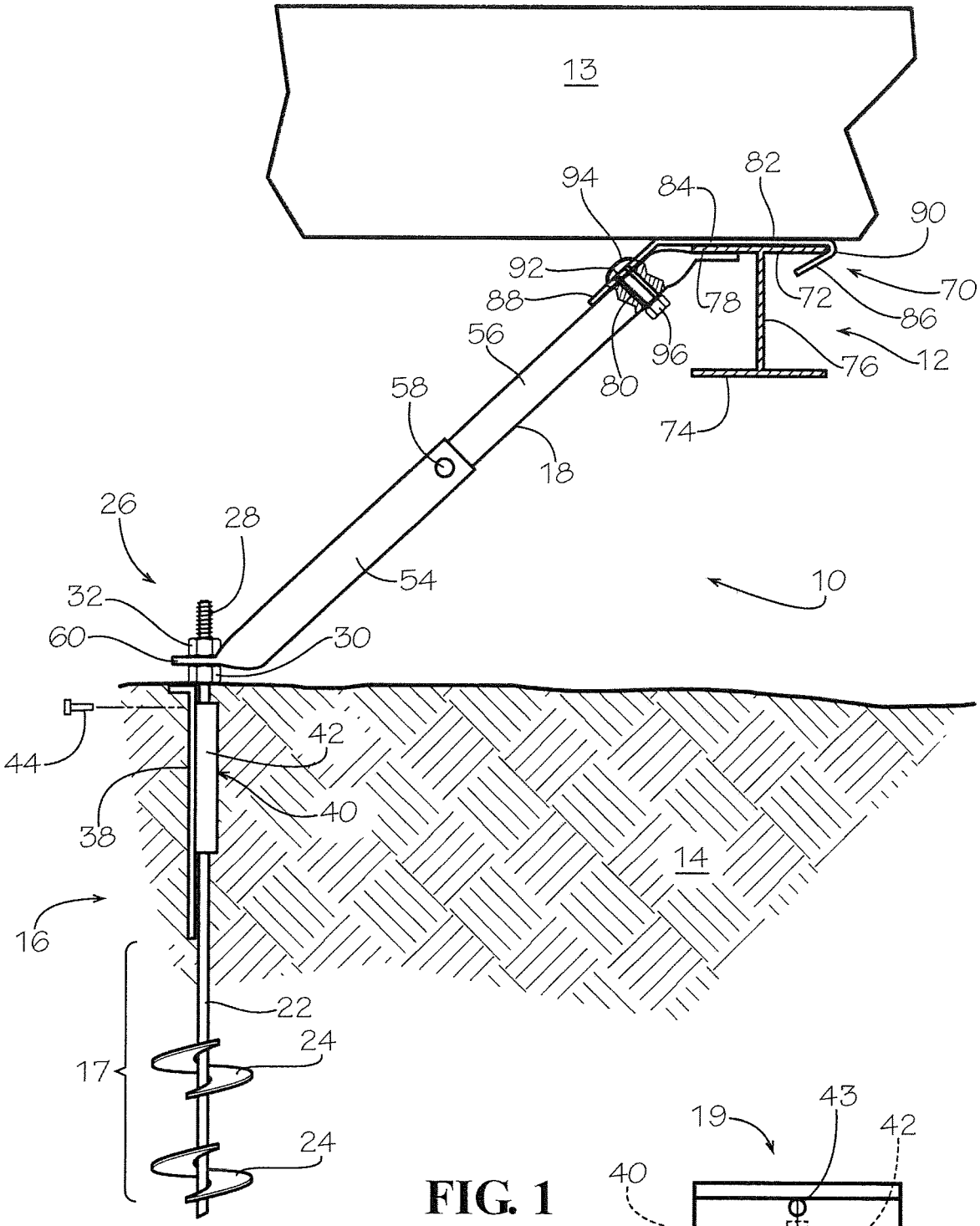
FIG. 1 illustrates a side view of a first embodiment of a stabilizer anchor in accordance with the present invention.

With reference to the drawings in which like parts have like reference numerals, FIG. 1 illustrates a side view of a first embodiment of a stabilizer anchor 10 that connects between an I-beam 12 of a manufactured building generally 13 and the ground 14, in accordance with the present invention. The stabilizer anchor 10 includes an anchor 16 that engages the ground 14 and connects to a stabilizer member 18 that connects to the I-beam 12 of the manufactured building. The anchor 16 utilizes an auger device generally 17 and a stabilizer assembly 19 shown in front planar view in FIG. 1A. The stabilizer member 18 communicates tension or compression loading forces from the manufactured building 13 through the auger device 17 and stabilizer assembly 19 to the ground 14.

The auger device 17 of the anchor 16 comprises an elongated rod 22 having at least one helical flight 24 rigidly attached at a first end. The helical flight 24 facilitates turning the anchor 16 through the ground 14 during engagement of the anchor with the ground. A connector 26 defines an opposing end of the rod 22. In the illustrated embodiment, the connector 26 comprises a threaded distal end 28 having a first nut 30 and a second nut 32 threadably engaged to the distal end. The threaded distal end 28 may be a threaded portion of the rod 22 that receives the nut 30 and nut 32. The nut 30 seats at an inward extent of the threaded portion and is preferably rigidly connected thereat such as by welding. In an alternate embodiment, the threaded end is defined by a bolt disposed coaxially with the rod 22 and welded rigidly with the head of the bolt at an end of the rod.

Figure 1A:
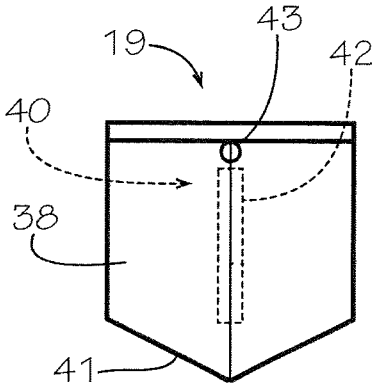
FIG. 1A illustrates a front planar view of a stabilizer plate for the stabilizer anchor illustrated in FIG. 1.

As best illustrated in FIG. 1A, the anchor 16 further includes the stabilizer assembly 19 having a blade or plate 38 and a seating member 40. The plate 38 in the illustrated embodiment has chevron appearance in plan view to define a V-shape lower edge 41 having a pointed apex. The seating member 40 in the illustrated embodiment comprises an open-ended tube 42 that welds on a longitudinal axis of the plate 38. The tube 42 is sized for receiving the rod 22 therethrough. The stabilizer assembly 19 moves on the rod 22 relative to the anchor 16 during installation of the anchor in the ground 14, as discussed below. With continuing reference to FIG. 1, the stabilizer assembly 19 is illustrated on the rod 22 remote from the I-beam 12, but may be disposed on the opposing side proximate the I-beam during installation. The rod 22 receives the stabilizer assembly 19 by passing through the tube 42 prior to securing the nut 30 to the threaded end or attaching the bolt to define the threaded end. The seating member 40 may further selectively fix securely to the rod 22. In the illustrated embodiment, the plate 38 defines an opening 43 (see FIG. 1A). A fastener 44 extends threadably through the opening 43 and bears against the rod 22 to wedge the plate 38 into fixed position relative to the rod. Other wedging or securing mechanisms may be gainfully employed to fix the stabilizer assembly 19 relative to the anchor 16.

The stabilizer member 18 comprises a first elongated tube 54 that telescopically receives a second elongated tube 56. A fastener 58, such as a threaded screw or bolt and nut extending transverse into or through the joined tubes 54, 56 secures the telescoped tubes together. The first tube 54 attaches to the connector 26. In the illustrated embodiment, the first tube 54 has a flanged end 60 defined by pressing and flattening an end portion of the tube. The flanged end 60 defines a through opening. The threaded end of the rod 22 extends through the opening to seat the first tube 54 on the anchor 16. The flanged end 60 seats on the first nut 30, and the second nut 32 bearing thereon secures the flanged end 60 therebetween to the rod 22.

The stabilizer member 18 connects with a beam clamp 70 to the I-beam 12. The I-beam 12 is conventional having an upper flange plate 72 and a spaced-apart lower flange plate 74. A web 76 connects between the pair of opposing flange plates 72, 74. In the illustrated embodiment, the second tube 56 defines a flattened end 78 and a through opening 80 spaced longitudinally from the end 78. The beam clamp 70 comprises a plate 82 having a central portion 84 and opposing end portions 86, 88. The central portion 84 defines a beam contact surface to sit on the upper flange plate 72 of the I-beam 12. The end portion 86 defines a reversed angled hook 90 for engaging a lateral edge of the upper flange plate 72 distal from the anchor 16. The opposing end portion 88 angles at an oblique angle from a planar surface of the central portion 84. The end portion 88 defines an opening 92. A bolt 94 extends through the openings 92, 80 and a nut 96 secures the beam clamp 70 to the stabilizer member 18. The flattened end 78 bears against an under surface of the upper flange plate 72 on the opposing side of the web 76 from the side engaged by the hook 90.

Figure 2:
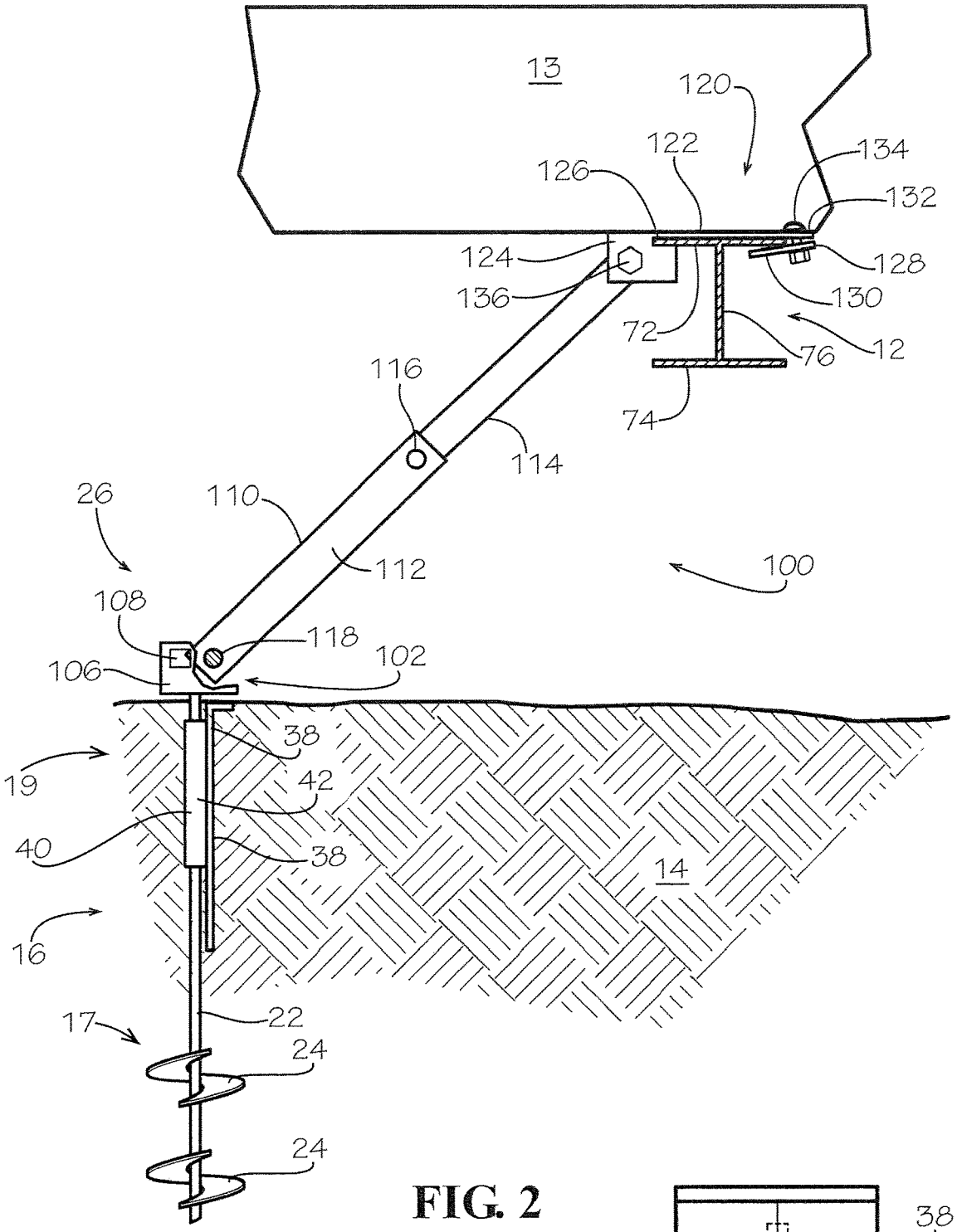
FIG. 2 illustrates a side view of a second embodiment of a stabilizer anchor, anchor, in accordance with the present invention.
Figure 2A:
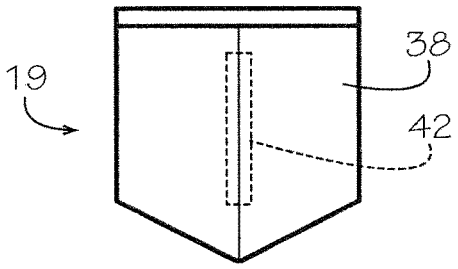
FIG. 2A illustrates a front planar view of a stabilizer plate for the stabilizer anchor illustrated in FIG. 2.

FIG. 2 illustrates a side view of a second embodiment of a stabilizer anchor 100, in accordance with the present invention. As best illustrated in FIG. 2A, the anchor 16 further includes an alternate embodiment of the stabilizer assembly 19 having the blade or plate 38 and the open-ended tube 42 as the seating member 40. The stabilizer anchor 100 uses for the connector 26 in the anchor 16 an anchor head 102. The anchor head 102 comprises a U-shaped bracket having a base plate and a pair of upstanding side walls 106. Each side wall 106 defines at least one opening 108 that aligns with the opening 108 in the opposing side wall. In the illustrated embodiment, the anchor head 102 define a pair of openings 108 in each side wall 106. A stabilizer arm 110 in this embodiment includes a first tube 112 and a second tube 114. The tubes 112, 114, telescope together to a selected length and are secured with a fastener 116. The opposing distal ends of the respective tubes 112, 114 define respective through openings. The opening in the tube 112 aligns with the opening 108 and a bolt 118 extends through the aligned openings. A nut tightened on the bolt 118 secures the tube 112 to the anchor head 102.

The stabilizer anchor 100 uses an alternate beam clamp 120 having a top plate 122 and opposing side walls 124 that define a slot 126 for receiving a portion of the upper flange 72. Each side wall 124 defines an opening that aligns with the opposing opening. In the illustrated embodiment, the side wall defines the opening lateral and spaced vertically lower than the slot 126. A distal portion of the top plate extends beyond the lateral edge of the flange plate 72. The distal portion defines an opening. A bearing plate 130 defines an opening and seats at an oblique angle relative to the plate 122 to bear against an under surface of the flange plate 72. The aligned openings receive a bolt 134 and a nut secures the plate 122 forcibly against the flange 72. The side walls 124 receive therebetween the distal end of the tube 114 with the opening therein aligning with the openings in the side walls. A bolt 136 extends through the aligned openings in the side walls 124 and the through opening in the tube 114. A nut attaches to the bolt to secure the tube 114 to the beam connector 120. FIG. 2 illustrates the stabilizer assembly 19 on the rod 22 of the anchor 16 proximate the I-beam 12.

Figure 3:
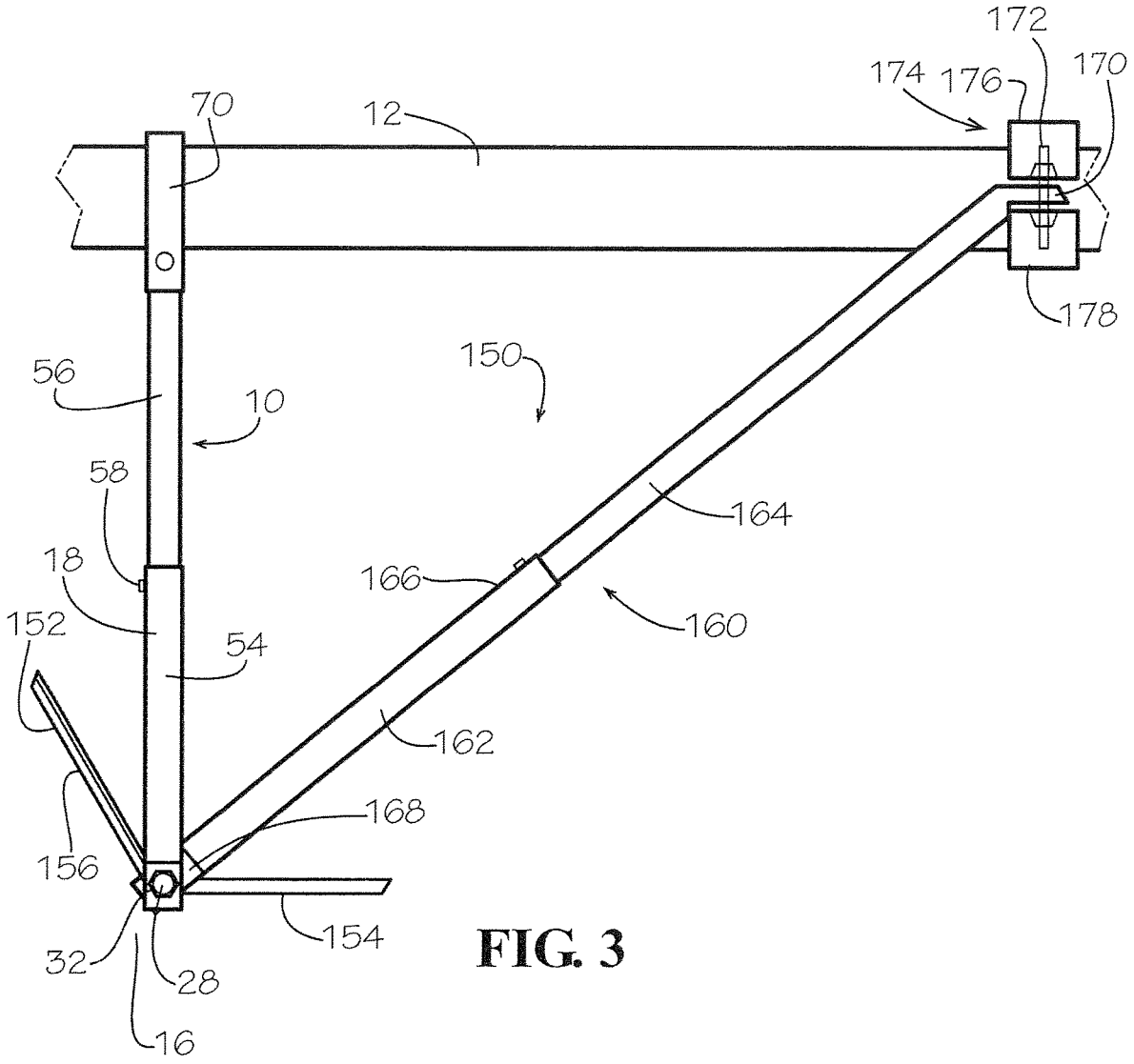
FIG. 3 illustrates in top plan view a third embodiment of a stabilizer anchor disposed laterally of an I-beam and having first and second stabilizer members connected between the anchor and the I-beam, in accordance with the present invention.
Figure 5:
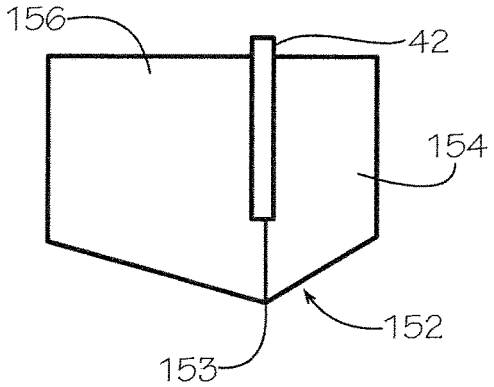
FIG. 5 illustrates in detail side view an alternate embodiment of the stabilizer assembly as illustrated in use in the third embodiment of the stabilizer anchor illustrated in FIG. 3.

FIG. 3 illustrates in top plan view a third embodiment of a stabilizer anchor 150 disposed laterally of an I-beam and having first and second stabilizer members 18 and 160 connected between the anchor 16 and the I-beam 12, in accordance with the present invention providing both longitudinal and lateral force resistance. Further illustrated is an alternate embodiment of the stabilizer assembly 152 rather than the stabilizer assembly 19. As shown in FIG. 5, the stabilizer assembly 152 comprises a plate 153 bent at an oblique angle along a central axis to define a pair of plates 154, 156. Alternatively, separate plates 154, 156 are welded together at an oblique angle to define a V-shape in top plan view. The tube 42 welds rigidly to the plate 153 on the central axis. With continuing reference to FIG. 3, the stabilizer anchor 150 uses the stabilizer anchor 10 discussed above, and additionally includes a longitudinal brace 160 comprising first and second telescoping tubes 162, 164. A fastener 166 connects the tubes 162, 164 together. The tube 162 defines a flattened end portion 168 and opening for receiving the threaded portion 28 of the anchor rod 22. The tube 164 defines a flattened end portion 170 and opening for receiving a bolt 172 for connecting the tube to a longitudinal beam clamp 174. The longitudinal beam clamp 174 is of a clamp type disclosed in U.S. Pat. No. 7,140,157 as clamp 10 therein or in U.S. Pat. No. 6,505,447 as clamp or connector 32 having rear and front clamp members 33R and 33F therein, which disclosures are incorporated herein in their entities by reference. The beam clamp 174 includes rear and front clamp members 176, 178 connected by the bolt 172 and nut. The bolt 172 extends through the opening in the flattened end portion 170 to secure the tube 164 to the I-beam 12.

Figure 4:
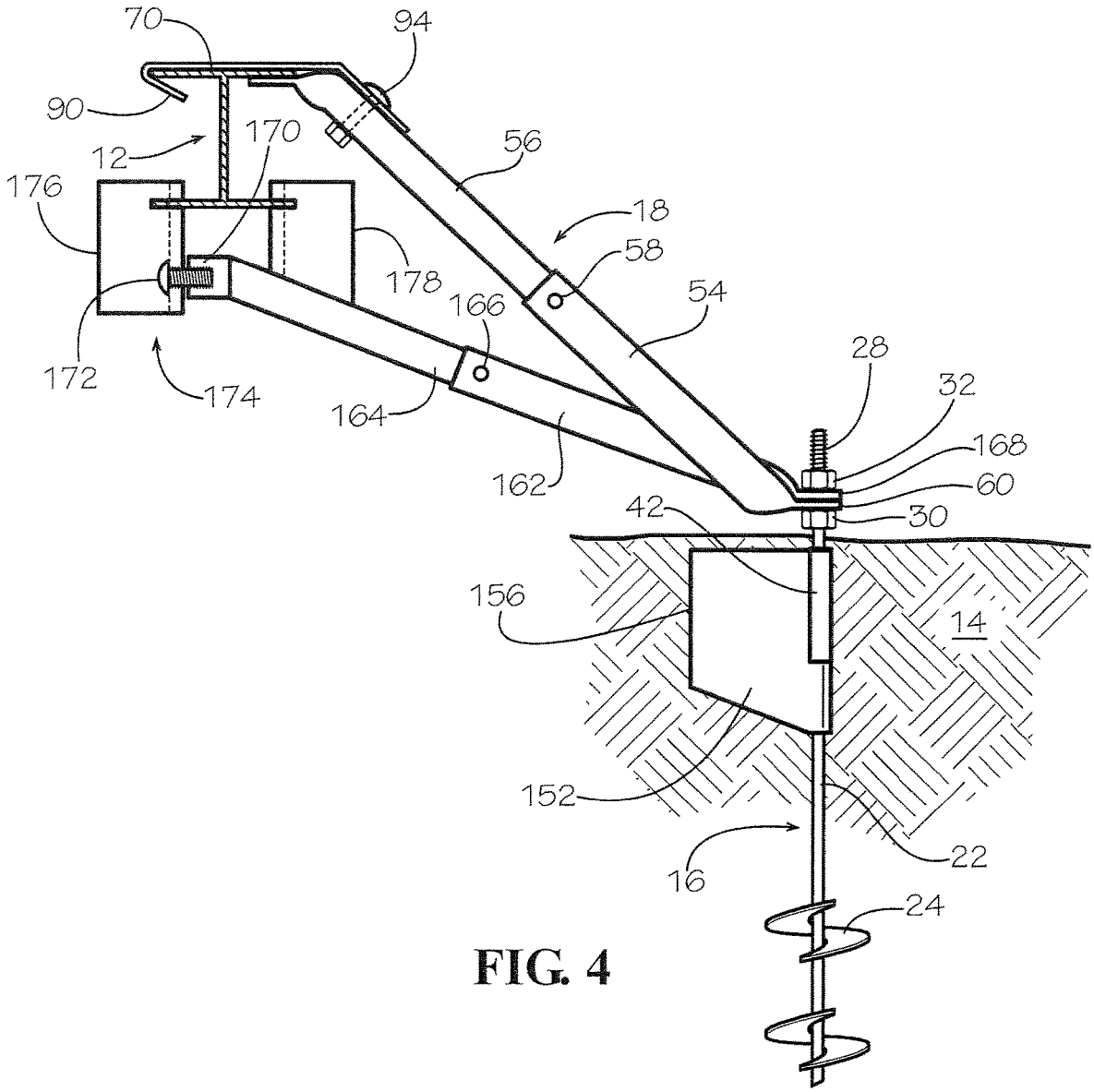
FIG. 4 illustrates in end view the third embodiment of the stabilizer anchor illustrated in FIG. 3.

FIG. 4 illustrates in end view the third embodiment of the stabilizer anchor 150 illustrated in FIG. 3.

FIG. 5 illustrates in detail side view the stabilizer assembly 152 used in the third embodiment of the stabilizer anchor 150 illustrated in FIG. 3.

Figure 6:
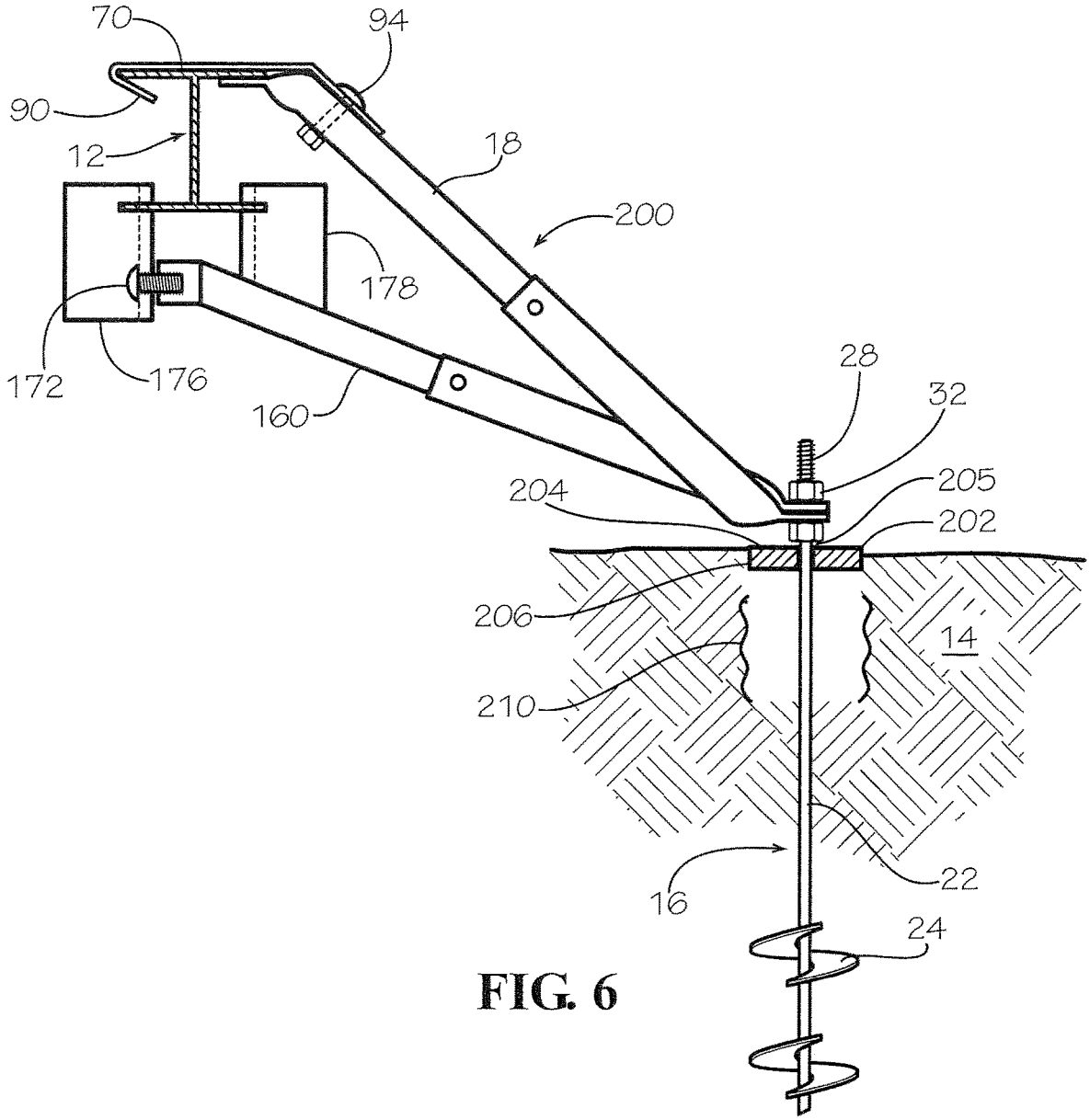
FIG. 6 illustrates in end view a fourth embodiment of a stabilizer anchor in accordance with the present invention.
Figure 9:
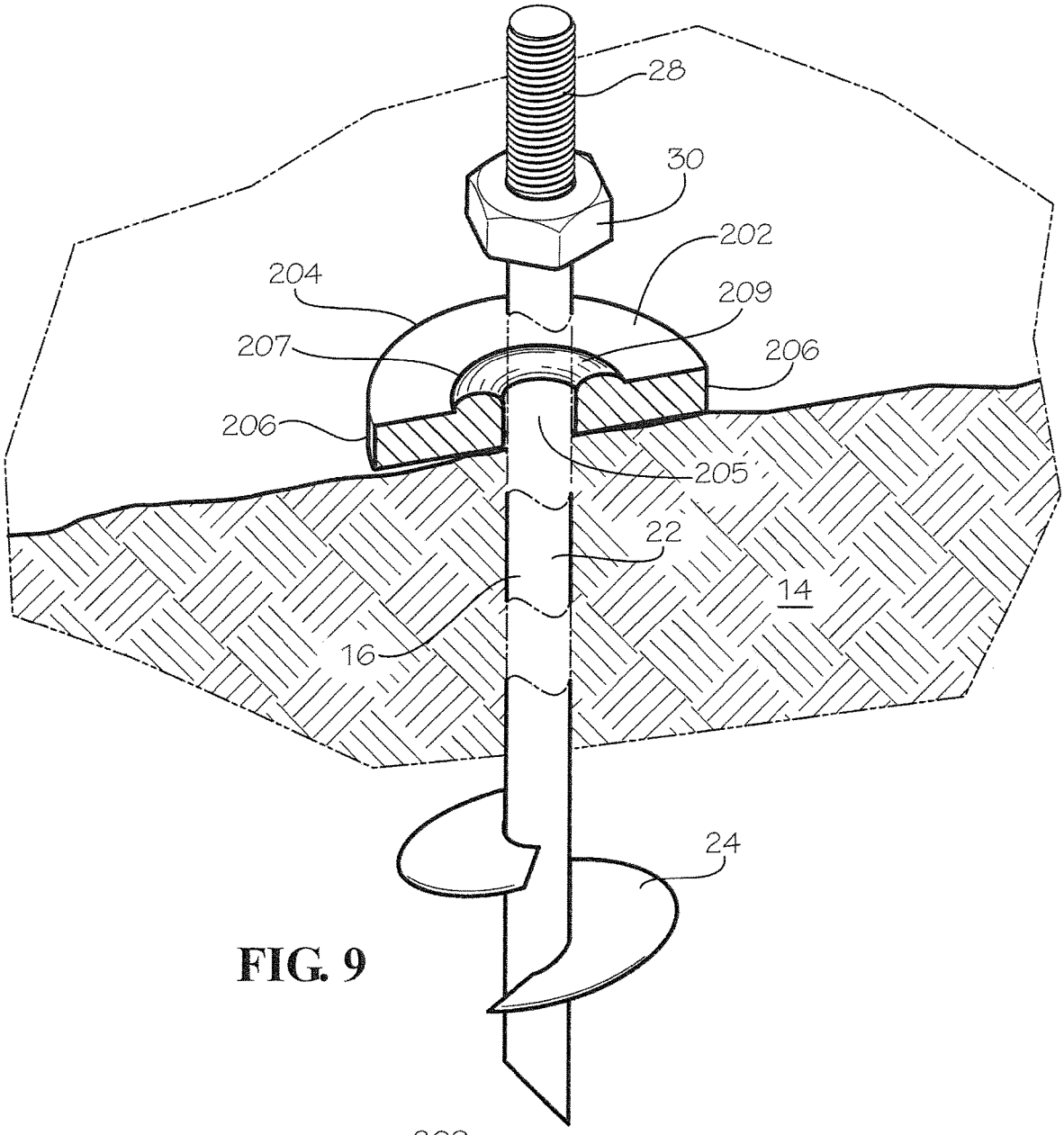
FIG. 9 illustrates in exploded cut-away view a cap used with a stabilizer anchor.
Figure 10:
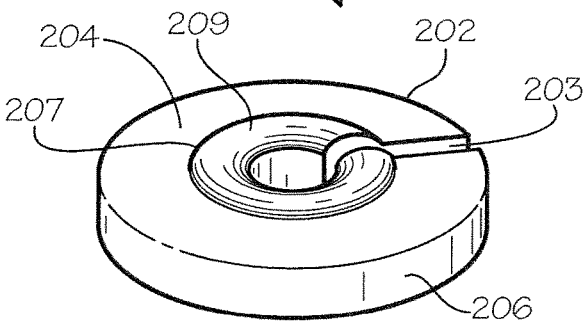
FIG. 10 illustrates an alternate embodiment of the cap having a radial slot for receiving the rod of the stabilizer anchor.

FIG. 6 illustrates in side view a fourth embodiment of a stabilizer anchor 200 in accordance with the present invention. This embodiment positions a cylindrical cap 202 at the end of the rod 22 opposing the helical flights 24. The cylindrical cap 202 is a dish having a base 204 from which a perimeter wall 206 extends. As shown in FIG. 6, the base 204 defines a central opening 205 with an annular projecting knuckle 207 having an arcuate ridge 209, as best illustrated in exploded cut-away view in FIG. 9. The ridge 209 may be a built-up portion of weld bead. The rod 22 receives the cap 202 with the bolt or threaded portion 28 extending coaxially therefrom. In an alternate embodiment illustrated in FIG. 10, the cap 202 defines a radial slot 203 for passage of the rod 22 such as during placement of the cap 202. The cap 202 pivots relative to rod 22 to conform to a slope of the ground 14. In alternate embodiment, the cap 202 welds in place. During rotation of the anchor 16 into the ground, the cap 202 compresses the soil and dirt between the helical flight 24 and the cap, to define a compressed column 210 of soil therebetween in the ground 14. The compressed column 210 of dirt has a density that is increased over a density of the adjacent soil. The cap 202 and the compressed column 210 resists lateral and longitudinal movement of the anchor 16 in the ground 14, which receives the tension and compression load forces. Further, the stabilizer assembly 19 or 153 may be gainfully used for additional resistance to tension and compression load forces communicated through the anchor 16 to the ground 14.

Figure 7:
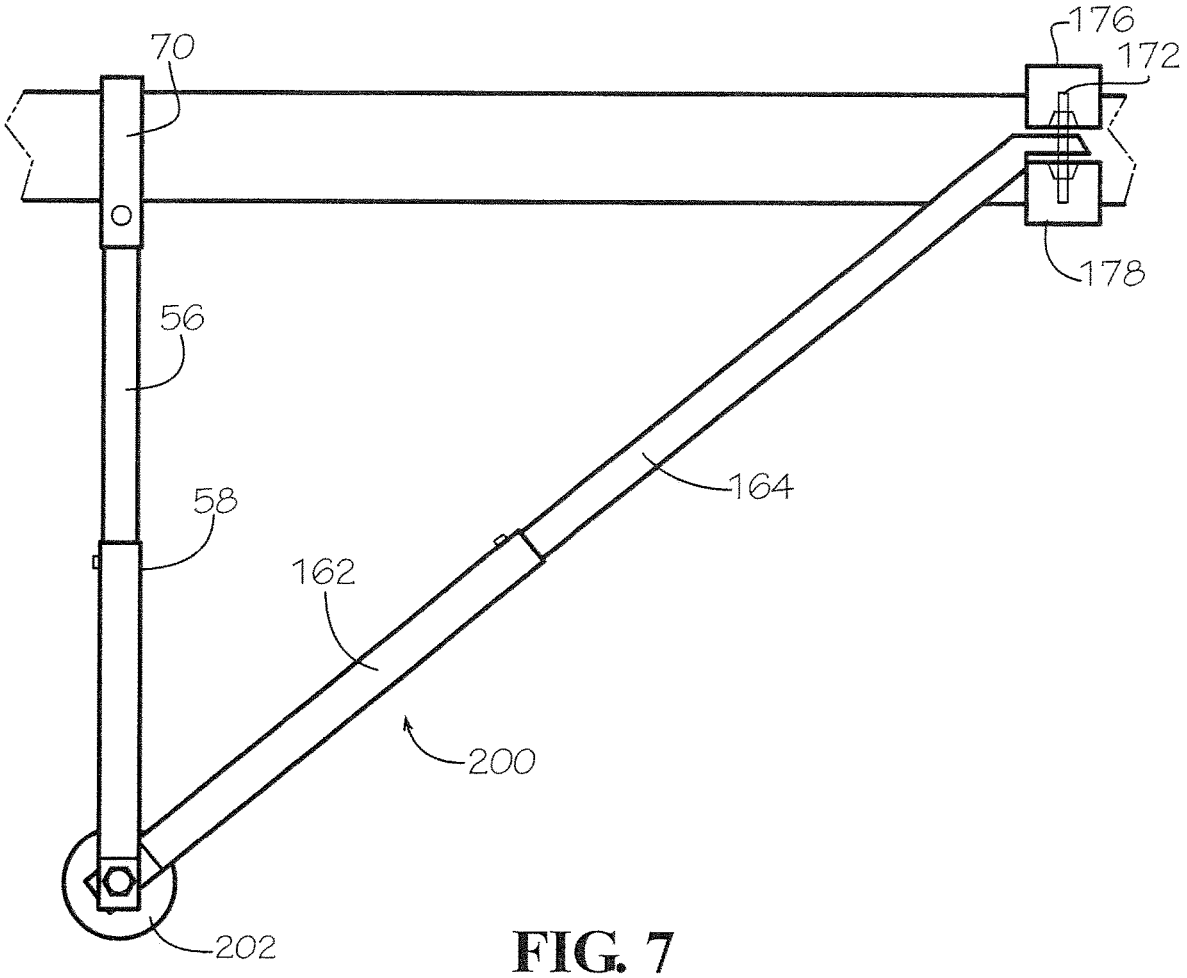
FIG. 7 illustrates in top plan view the fourth embodiment of the stabilizer anchor illustrated in FIG. 6.

FIG. 7 illustrates in top plan view the stabilizer anchor 200 illustrated in FIG. 6.

Figure 8:
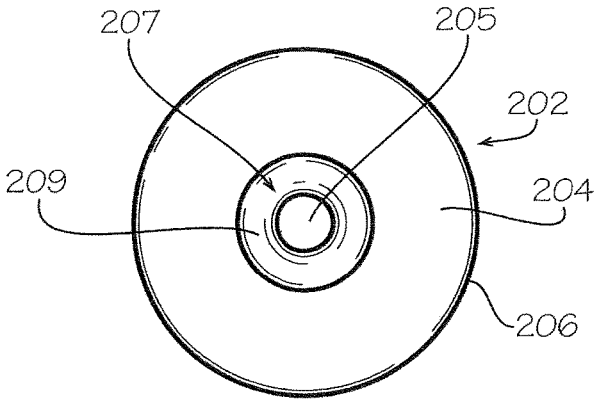
FIG. 8 illustrates in top plan view an embodiment of the cap used with the fourth embodiment of the stabilizer anchor illustrated in FIG. 6.

FIG. 8 illustrates in top plan view the cap 202 used with the stabilizer anchor 200 illustrated in FIG. 6.

With reference to FIG. 1, the stabilizer anchor 10 communicates tension or compression loading force from the manufactured building 13 through the stabilizer member 18 to the anchor 16 having the auger device 17 and the stabilizer assembly 19 and to the ground 14. A manufacturer assembles the stabilizer anchor 10 by first placing the stabilizer assembly 19 on the rod 22. The stabilizer assembly 19 positions with the lower edge 41 towards the helical flight 24. The rod 22 extends through the tube 42. The threaded end 28 of the rod 22 receives the first nut 30, and preferably the nut 30 is welded in position. The alternate embodiment welds the bolt to the end of the rod 22 after receiving the stabilizer assembly 19. The rigid nut 30 or head of the bolt facilitates tool-assisted rotation of the anchor 16 for the helical flight 24 to dig and drive the rod 22 into the ground 14. It is to be appreciated that the anchor 16 and stabilizer assembly 19 may be field assembled. Further, the stabilizer anchor 10 as illustrated in FIG. 1 may use the stabilizer assembly 152 having the angled plates 154, 156 rather than use the stabilizer assembly 19. Also further, an alternate embodiment of the systems illustrated in FIGS. 1 and 2 gainfully use the cap 202. In such embodiment the use of the cap 202 and the stabilizer assembly 19 or 152 is optional whereby either the cap or the stabilizer assembly is used for the anchor, although in yet another alternate embodiment both the cap and the stabilizer assembly are used.

The anchor 16 is held substantially perpendicular to the ground 14 with the end having the helical flight 24 on the ground. The anchor 16 is rotated and the helical flight 24 pulls the rod 22 into the ground. The anchor 16 may be rotated with a lever or tool such as a wrench or power driver that engages the nut 30 or bolt head. The rotation of the rod 22 and the digging of the helical flight 24 may also move the stabilizer assembly 19 into the ground. Alternatively, after contact of the lower edge 41 with the ground, the stabilizer assembly 19 may be hammered to drive the stabilizer assembly into the ground. In many installations, the passage of the helical flight first into the ground 14 is sufficient to allow the rotating flight to also move the stabilizer assembly 19 into the ground. The V-shaped lower edge 41 facilitates the passage of the stabilizer assembly into the ground. The anchor 16 is driven until the upper edge of the stabilizer assembly 19 is at or below, or flush with, the surface of the ground 14.

The stabilizer member 18 is then installed. The transverse beam clamp 70 attaches to the I-beam 12. The hook 90 of the clamp overlies the edge of the upper flange 72 distal from the anchor 16. The tube 54 receives the tube 56 and telescope together. The tube 54 attaches to the connector 26. In the illustrated embodiment, the threaded end of the rod 22 extends through the opening 62 in the flanged end 60 of the tube 54. The second nut 32 attaches to the threaded rod 22. The flanged end 78 of the tube 56 is positioned under the upper flange plate 72 on the proximate side of the web 76 with the opening 80 aligned with the opening 92 of the angled portion 88 of the beam clamp 70. The bolt 94 extends through the aligned openings and the nut 96 threads to secure the tube 56 to the beam clamp 70. The nuts 32 and 96 are tightened. The tubes 54 and 56 lock together by the fastener 58 that is driven through the side walls of the tubes.

Additional stabilizer anchors 10 are installed on the manufactured building on opposing sides in spaced-apart relation. The number of stabilizer anchors 10 is based on soil and wind loading requirements of the location of the manufactured building. The wind load imposes lateral and transverse forces on the building. The loading communicates through the stabilizer member 18 to the anchor 16 and the ground 14, so that the manufactured building remains stabilized and resists movement. The plate 38 embedded in the ground 14 bears against the ground 14 to cooperatively increase the resistance of the building to movement in response to loading. Particularly, the plate 38 resists the tension or compression load forces that communicate therethrough to the ground 14.

The embodiment illustrated in FIG. 2 similarly installs. In this embodiment, the beam clamp 120 installs with the slot 126 receiving the upper flange 72 proximate the anchor 16. The bearing plate 130 is held below the distal end of the plate 122 and against the undersurface of the flange plate 72 with the opening 132 aligned with the opening 128. The bolt 136 extends thought the aligned openings and receives a nut. The tubes 114, 116 telescope together. The opening in the tube 114 aligns with the openings 108 in the side walls of the anchor head 102. The bolt 118 extends through the aligned openings of the tube 114 and the anchor head 102 and receives the nut. The opening in the tube 114 aligns with the openings in the side walls of the beam clamp 120. The bolt extending through the aligned openings receives the nut to secure the tube 114 to the beam claim 120. The tubes 114, 116 secure together with the fastener. The loading on the manufactured building communicates through the stabilizer member 110 to the anchor 16 and the ground 14, so that the manufactured building remains stabilized and resists movement. The plate 38 embedded in the ground 14 bears against the ground to cooperatively increase the resistance of the building to movement in response to tension and compression loading. Particularly, the plate 38 resists the tension or compression load forces that communicate therethrough to the ground 14.

With reference to FIGS. 3 and 4, the stabilizer anchor 150 assembles and installs between the I-beam 12 and the ground 14 similarly as discussed above. The rod 22 of the anchor 16 receives the stabilizer assembly 152 by extending longitudinally through the tube 42. Preferably this is accomplished during manufacture remote from the installation site. In a first embodiment, the nut 30 then seats on the threaded end 28 and is rigidly fixed thereat. In a second embodiment, a bolt welds onto the end of the rod 22 to define the threaded portion 28. The fixed nut 30 or bolt head facilitate rotation of the anchor during installation and removal by reverse rotation and backing out of the helical flight 24 if necessary. In an alternate embodiment, the nut 30 is field installed.

Rotating the anchor 16 drives the anchor into the ground 14 by the helical flights 24 that dig into the ground. The stabilizer assembly 152 may cut into the ground 14 or alternatively, the rotation may stop, and the stabilizer assembly hammered downwardly to force the stabilizer plates 154, 156 into the ground. The stabilizer assembly 152 moves longitudinally relative to the anchor 16 on the rod 22. Once the stabilizer assembly 152 is flush or at grade, the anchor 16 again may be rotated to sink the anchor further into the ground 14. The transverse beam clamp 70 attaches to the I-beam 12 and the stabilizer member 18 connects between the beam clamp and the anchor 16, as discussed above. The longitudinal beam clamp 174 attaches to the I-beam 12. The tube 164 connects to the longitudinal beam clamp 174. The opening in the flattened end 168 receives the threaded portion 28 of the anchor rod 22. The nut 32 engages the threaded portion 28 and secures the stabilizer members 160 and 18 to the anchor 16. The fastener 166 secures the telescoped tubes 162, 164 together.

In an embodiment in which the anchor 16 is positioned lateral of the I-beam 12, the stabilizer member 18 is disposed perpendicular to the I-beam (horizontal plane) and the stabilizer member 164 is disposed at an oblique angle (horizontal plane) relative to the I-beam. In an embodiment in which the anchor 16 is vertically below the I-beam 12, the stabilizer member 164 is disposed substantially in alignment with a longitudinal axis of the I-beam 12. In this embodiment, the stabilizer member 18 connects to a second spaced-apart I-beam.

The wind load imposes lateral and transverse forces on the building. The loading communicates through the stabilizer members 18 (transverse loading resistance) and 160 (longitudinal loading resistance) to the anchor 16 and the ground 14, so that the manufactured building remains stabilized and resists movement. The plate 152 embedded in the ground bears against the ground at differing angles to cooperatively increase the resistance of the building to movement in response to loading.

With reference to FIG. 6, the stabilizer anchor 200 creates the compressed column 210 during installation of the anchor 16 by the cap 202 compressing soil dislodged by the helical flight 24. The compressed column 210 has a density that is increased over a density of the adjacent soil. The cap 202 and the compressed column 210 resists lateral and longitudinal movement of the anchor 16 in the ground 14, which receives the tension and compression load forces. Further, the stabilizer assembly 19 or 153 may be gainfully used with the stabilizer anchor 200 system for additional resistance to tension and compression load forces communicated through the anchor 16 to the ground 14. The cap 202 pivots by the knuckle 207 bearing on the nut 30 or the head of the bolt that defines the threaded portion 28, allowing the cap to be angled in substantial conformity with the slope of the ground 14.

While the foregoing describes the invention in detail with reference to specific exemplary embodiments thereof, it will be appreciated that various modifications and changes may be made thereto without departing from the broader spirit and scope of the invention as set forth in the appended claims. The specification is, accordingly, to be regarded as illustrative rather than restrictive.

What is claimed is:

1. A stabilizer anchor assembly for securing a manufactured building to the ground while providing resistance to movement thereof in response to forces directed against the manufactured building, comprising:

an anchor having an elongated rod with a helical flight at a first end and a threaded connector at an opposing second end that receives a first nut;

a stabilizer assembly having a plate and a seating member that slidingly receives the rod for movement of the stabilizer assembly relative to the rod during installation of the anchor relative to an elongate longitudinal I-beam on which a manufactured building is supported, the plate for engaging the ground after installation, said stabilizer assembly comprising a cylindrical cap having a base and a perimeter wall extending in a first direction therefrom defining the plate, the base defining a central opening for the seating member through which the rod extends and an annular knuckle projecting from an upper surface of the base to define a ridge, the ridge bearing against the first nut whereby the cap may be angled relative to the anchor in substantially conformity with a slope of the ground surface thereat; and a stabilizer member for connecting at a first end to the connector of the anchor and at a second end to the longitudinal I-beam, whereby forces on the manufactured building communicate therefrom through the stabilizer member to the ground through the anchor, whereby the plate, being moved relative to the rod during installation in the ground, resists movement of the manufactured building in response to forces against the manufactured building.

2. The stabilizer anchor assembly as recited in claim 1, further comprising a second nut received on the threaded connector for securing the first end of the stabilizer member to the anchor.

3. The stabilizer anchor assembly as recited in claim 2, wherein the stabilizer member comprises an elongate tube and the first end defines aligned openings in opposing sides for receiving therethrough the threaded connector, the first end sitting on the first nut received on the threaded connector and the second nut tightened thereagainst for securing the stabilizer member to the anchor.

4. The stabilizer anchor assembly as recited in claim 3, wherein the first end of the stabilizer member is flattened.

5. The stabilizer anchor assembly as recited in claim 1, further comprising means for securing the stabilizer assembly to the rod after installation of the anchor.

6. The stabilizer anchor assembly as recited in claim 1, further comprising means for rigidly securing the plate to the rod after installation.

7. The stabilizer anchor assembly as recited in claim 6, wherein means for securing comprises:

the plate defining an opening;

a fastener extending through the opening and contacting the rod, for bearing securing of the plate to the rod.

8. The stabilizer anchor assembly as recited in claim 1, further comprising a beam connector for attaching to the I-beam of the manufactured building and connecting to a second end of the stabilizer member.

9. The stabilizer anchor assembly as recited in claim 1, wherein the cap defines a radial slot from a central portion to an edge for receiving the rod.

10. The stabilizer anchor assembly as recited in claim 1, wherein the knuckle comprises a weld bead attached to the base.

11. The stabilizer anchor assembly as recited in claim 1, wherein the stabilizer member is aligned substantially parallel with the longitudinal axis of the I-beam.

12. The stabilizer anchor assembly as recited in claim 1, wherein the stabilizer member is at an oblique angle relative to the longitudinal axis of the I-beam.

13. The stabilizer anchor assembly as recited in claim 1, wherein the stabilizer member is transverse to the longitudinal axis of the I-beam determined in a horizontal plane relative to the I-beam.

14. The stabilizer anchor assembly as recited in claim 1, further comprising a second stabilizer member connected at a first end to the connector of the anchor and at a second end to the longitudinal I-beam, the second stabilizer member transverse to the longitudinal axis of the I-beam determined in a horizontal plane relative to the I-beam, whereby forces on the manufactured building communicate therefrom through the stabilizer member to the ground through the anchor.

15. A method for securing a manufactured building to the ground with a stabilizer anchor assembly that provides resistance to movement thereof in response to forces directed against the manufactured building, comprising the steps of:

(a) slidingly extending a rod of an anchor through a seating member of a stabilizer assembly, the anchor having a helical flight at a first end for engaging a portion of ground below a longitudinal I-beam on which a manufactured building is supported and an opposing second end having a connector, said stabilizer assembly comprising a cap having a base and a perimeter wall extending in a first direction therefrom defining the plate for engaging the ground, the base defining a central opening for the seating member through which the rod extends and an annular knuckle projecting from an upper surface of the base; and (b) driving the anchor and the stabilizer assembly into the ground, the stabilizer assembly moving relative to the rod during installation of the anchor and the plate engaging the ground after installation with the cap angled relative to the anchor in substantial conformity with a slope of the ground by pivoting the cap on a ridge of the annular knuckle;

(c) connecting a first end of a stabilizer member to the connector of the anchor and connecting a second end of the stabilizer member to the longitudinal I-beam, whereby forces on the manufactured building communicate therefrom through the stabilizer member to the ground through the anchor, whereby the plate, being moves relative to the rod during installation in the ground, resists movement of the manufactured building in response to forces against the manufactured building.

16. The method for securing a manufactured building to the ground as recited in claim 15, further comprising the step of securing the stabilizer assembly rigidly to the rod.

17. The method for securing a manufactured building to the ground as recited in claim 16, wherein securing the stabilizer assembly comprises providing an opening through the plate and securing a fastener therein for bearing fixedly against the rod.

18. The method for securing a manufactured building to the ground as recited in claim 15, wherein the first end of the stabilizer member connects to a threaded end of the rod on which a first nut is threadingly received by extending the rod through the central opening in the stabilizer member and securing the first end thereto with a second nut tightened thereon.

19. The method for securing a manufactured building to the ground as recited in claim 18, wherein the stabilizer member comprises an elongated tube and the first end being flattened and defining aligned openings therein for passing the rod therethrough.

20. The method for securing a manufactured building to the ground as recited in claim 15, further comprising the step of forming the plate to have a first plate and a second plate disposed at an oblique angle relative to a central axis.

21. The method for securing a manufactured building to the ground as recited in claim 15, wherein the stabilizer member is disposed at an oblique angle determined in a horizontal plane relative to the I-beam.

22. The method for securing a manufactured building to the ground as recited in claim 15, further comprising the step of connecting a first end of a second stabilizer member to the connector of the anchor and connecting a second end of the second stabilizer member to the longitudinal I-beam, the second stabilizer member disposed transverse to a longitudinal axis of the I-beam as determined in a horizontal plane relative to the I-beam, whereby forces on the manufactured building communicate therefrom through the stabilizer member to the ground through the anchor.

23. A stabilizer anchor assembly for securing a manufactured building to the ground while providing resistance to movement thereof in response to forces directed against the manufactured building, comprising:

an anchor having an elongated rod with a helical flight at a first end and a connector at an opposing second end;

a stabilizer assembly having a plate and a seating member that slidingly receives the rod for movement of the stabilizer assembly relative to the rod during installation of the anchor relative to an elongate longitudinal I-beam on which a manufactured building is supported, the plate for engaging the ground after installation, said stabilizer assembly comprising a cylindrical cap having a base and a perimeter wall extending in a first direction therefrom defining the plate, the base defining a central opening for the seating member through which the rod extends, the cap defines a radial slot in the cap extending from the central opening to an edge for receiving the rod; and a stabilizer member for connecting at a first end to the connector of the anchor and at a second end to the longitudinal I-beam, whereby forces on the manufactured building communicate therefrom through the stabilizer member to the ground through the anchor, whereby the plate, being moved relative to the rod during installation in the ground, resists movement of the manufactured building in response to forces against the manufactured building.

24. The stabilizer anchor assembly as recited in claim 23, wherein the connector comprises a threaded portion and the stabilizer member comprises an elongate tube and a first end defines aligned openings in opposing sides for receiving therethrough the threaded portion, the first end sitting on a first nut received on the threaded portion and a second nut tightened thereagainst for securing the stabilizer member to the anchor.

25. The stabilizer anchor assembly as recited in claim 23, wherein the first end of the stabilizer member is flattened.

26. The stabilizer anchor assembly as recited in claim 23, further comprising a beam connector for attaching to the I-beam of the manufactured building and connecting to a second end of the stabilizer member.

27. The stabilizer anchor assembly as recited in claim 23, wherein the stabilizer member is aligned substantially parallel with the longitudinal axis of the I-beam.

28. The stabilizer anchor assembly as recited in claim 23, wherein the stabilizer member is at an oblique angle relative to the longitudinal axis of the I-beam.

29. The stabilizer anchor assembly as recited in claim 23, wherein the stabilizer member is transverse to the longitudinal axis of the I-beam determined in a horizontal plane relative to the I-beam.

30. The stabilizer anchor assembly as recited in claim 23, further comprising a second stabilizer member connected at a first end to the connector of the anchor and at a second end to the longitudinal I-beam, the second stabilizer member transverse to the longitudinal axis of the I-beam determined in a horizontal plane relative to the I-beam, whereby forces on the manufactured building communicate therefrom through the stabilizer member to the ground through the anchor.

31. A stabilizer anchor assembly for securing a manufactured building to the ground while providing resistance to movement thereof in response to forces directed against the manufactured building, comprising:

an anchor having an elongated rod with a helical flight at a first end and a connector at an opposing second end;

a stabilizer assembly having a plate and a seating member that slidingly receives the rod for movement of the stabilizer assembly relative to the rod during installation of the anchor relative to an elongate longitudinal I-beam on which a manufactured building is supported, the plate for engaging the ground after installation; and a first stabilizer member for connecting at a first end to the connector of the anchor and at a second end to the longitudinal I-beam; and a second stabilizer member for connecting at a first end to the connector of the anchor and at a second end to the longitudinal I-beam, the second stabilizer member transverse to a longitudinal axis of the I-beam determined in a horizontal plane relative to the I-beam, whereby the plate, being moved relative to the rod during installation in the ground, resists movement of the manufactured building in response to forces against the manufactured building communicated through the first and second stabilizer members.

32. The stabilizer anchor assembly as recited in claim 31, wherein the first stabilizer member comprises an elongate tube and the first end defines aligned openings in opposing sides for receiving therethrough a threaded portion of the connector, the first end sitting on a first nut received on the threaded portion and a second nut tightened thereagainst for securing the stabilizer member to the anchor.

33. The stabilizer anchor assembly as recited in claim 31, wherein the first end of the first stabilizer member is flattened.

34. The stabilizer anchor assembly as recited in claim 31, further comprising a beam connector for attaching to the I-beam of the manufactured building and connecting to a second end of the first stabilizer member.

35. The stabilizer anchor assembly as recited in claim 31, wherein the first stabilizer member is aligned substantially parallel with the longitudinal axis of the I-beam.

36. The stabilizer anchor assembly as recited in claim 31, wherein the first stabilizer member is at an oblique angle relative to the longitudinal axis of the I-beam.

37. The stabilizer anchor assembly as recited in claim 31, wherein the first stabilizer member is transverse to the longitudinal axis of the I-beam determined in a horizontal plane relative to the I-beam.

38. A method for securing a manufactured building to the ground with a stabilizer anchor assembly that provides resistance to movement thereof in response to forces directed against the manufactured building, comprising the steps of:

(a) slidingly extending a rod of an anchor through a seating member of a stabilizer assembly, the anchor having a helical flight at a first end for engaging a portion of ground below a longitudinal I-beam on which a manufactured building is supported and an opposing second end having a threaded portion that receives a first nut thereon; and (b) driving the anchor and the stabilizer assembly into the ground, the stabilizer assembly moving relative to the rod during installation of the anchor and the plate engaging the ground after installation;

(c) connecting a first end of a tubular stabilizer member to the threaded portion of the anchor, the first end flattened and defining opposing openings therein for passing the rod therethrough and a second nut threaded thereon to secure the first end to the anchor; and (d) connecting a second end of the stabilizer member to the longitudinal I-beam, whereby forces on the manufactured building communicate therefrom through the stabilizer member to the ground through the anchor, whereby the plate, being moves relative to the rod during installation in the ground, resists movement of the manufactured building in response to forces against the manufactured building.

39. The method for securing a manufactured building to the ground as recited in claim 38, further comprising the step of securing the stabilizer assembly rigidly to the rod.

40. The method for securing a manufactured building to the ground as recited in claim 39, wherein securing the stabilizer assembly comprises providing an opening through the plate and securing a fastener therein for bearing fixedly against the rod.

41. The method for securing a manufactured building to the ground as recited in claim 38, further comprising the step of providing as the stabilizer assembly a cap disposed on the rod, the cap having a base and a perimeter wall extending in a first direction therefrom as the plate for engaging the ground, the base defining a central opening for the seating member through which the rod extends.

42. The method for securing a manufactured building to the ground as recited in claim 38, further comprising the step of angling the cap relative to the anchor in substantially conformity with a slope of the ground surface thereat by pivoting the cap on a ridge of an annular knuckle projecting from an upper surface of the base, the ridge bearing against the threaded portion.

43. The method for securing a manufactured building to the ground as recited in claim 38, wherein the stabilizer member is disposed at an oblique angle determined in a horizontal plane relative to the I-beam.

44. The method for securing a manufactured building to the ground as recited in claim 38, further comprising the step of connecting a first end of a second stabilizer member to the threaded portion of the anchor and connecting a second end of the second stabilizer member to the longitudinal I-beam.

45. A method for securing a manufactured building to the ground with a stabilizer anchor assembly that provides resistance to movement thereof in response to forces directed against the manufactured building, comprising the steps of:

(a) slidingly extending a rod of an anchor through a seating member attached to a plate of a stabilizer assembly, the anchor having a helical flight at a first end for engaging a portion of ground below a longitudinal I-beam on which a manufactured building is supported and an opposing second end having a connector; and (b) driving the anchor and the stabilizer assembly into the ground, the stabilizer assembly moving relative to the rod during installation of the anchor and the plate engaging the ground after installation;

(c) connecting a first end of a stabilizer member to the connector of the anchor and connecting a second end of the stabilizer member to the longitudinal I-beam;

(d) connecting a first end of a second stabilizer member to the connector of the anchor and connecting a second end of the second stabilizer member to the longitudinal I-beam, the second stabilizer member disposed transverse to a longitudinal axis of the I-beam as determined in a horizontal plane relative to the I-beam, whereby the plate, being moved relative to the rod during installation in the ground, resists movement of the manufactured building in response to forces against the manufactured building communicated therefrom through the stabilizer members to the ground through the anchor.

46. The method for securing a manufactured building to the ground as recited in claim 45, further comprising the step of securing the stabilizer assembly rigidly to the rod.

47. The method for securing a manufactured building to the ground as recited in claim 45, wherein securing the stabilizer assembly comprises providing an opening through the plate and securing a fastener therein for bearing fixedly against the rod.

48. The method for securing a manufactured building to the ground as recited in claim 45, further comprising the step of providing as the stabilizer assembly a cap disposed on the rod, the cap having a base and a perimeter wall extending in a first direction therefrom as the plate for engaging the ground, the base defining a central opening for the seating member through which the rod extends.

49. The method for securing a manufactured building to the ground as recited in claim 45, further comprising the step of angling the cap relative to the anchor in substantially conformity with a slope of the ground surface thereat by pivoting the cap on a ridge of an annular knuckle projecting from an upper surface of the base, the ridge bearing against the connector.

50. The method for securing a manufactured building to the ground as recited in claim 45, wherein the first end of the stabilizer member connects to a threaded end of the rod on which a first nut is threadingly received by extending the rod through the central opening in the stabilizer member and securing the first end thereto with a second nut tightened thereon.

51. The method for securing a manufactured building to the ground as recited in claim 50, wherein the stabilizer member comprises an elongated tube and the first end being flattened and defining aligned openings therein for passing the rod therethrough.

52. The method for securing a manufactured building to the ground as recited in claim 45, further comprising the step of forming the plate to have a first plate and a second plate disposed at an oblique angle relative to a central axis.

* * * * *